US005540027A

United States Patent [19]

Christensen et al.

[11] Patent Number: 5,540,027

[45] Date of Patent: Jul. 30, 1996

[54] SPRING BIASED APPARATUS FOR MAINTAINING PRECAST PANELS IN A STABLE REMOVABLE POSITION IN A VERTICAL SLOT

[75] Inventors: Stephen M. Christensen, Leesburg; Jerry J. McNeal, Mechanicsville, both of Va.; Gary S. Figallo, Silver Spring, Md.; Michael J. Cowell, Leesburg, Va.

[73] Assignee: The Reinforced Earth Company, Vienna, Va.

[21] Appl. No.: 399,567

[22] Filed: Mar. 7, 1995

Related U.S. Application Data

[63] Continuation-in-part of Ser. No. 311,209, Sep. 23, 1994, abandoned, which is a continuation of Ser. No. 997,871, Dec. 29, 1992, abandoned.

[51] Int. Cl.[6] ..... E04C 3/00

[52] U.S. Cl. ..... 52/459; 52/144

[58] Field of Search ..... 52/282.1, 282.4, 52/282.5, 459, 144, 259, 477, 769, 773, 774; 404/6; 256/19, 24–29, 13.1

[56] References Cited

U.S. PATENT DOCUMENTS

| | | | |
|---|---|---|---|
| 1,605,597 | 11/1926 | Long | 52/282.5 X |
| 3,123,186 | 3/1964 | Adkinson et al. | 52/282.4 X |
| 4,587,774 | 5/1986 | Wendt | 52/282.4 X |
| 5,353,561 | 10/1994 | Menchetti | 52/282.1 |
| 5,467,567 | 11/1995 | Christensen | 52/459 |

*Primary Examiner*—Carl D. Friedman
*Assistant Examiner*—Beth A. Aubrey
*Attorney, Agent, or Firm*—Banner & Allegretti, Ltd.

[57] ABSTRACT

An apparatus for wedging a road barrier panel between opposed flanges of an I-beam post that includes a spring biased arm retained in a recess hole within the back side of the panel.

9 Claims, 7 Drawing Sheets

FIG. 12
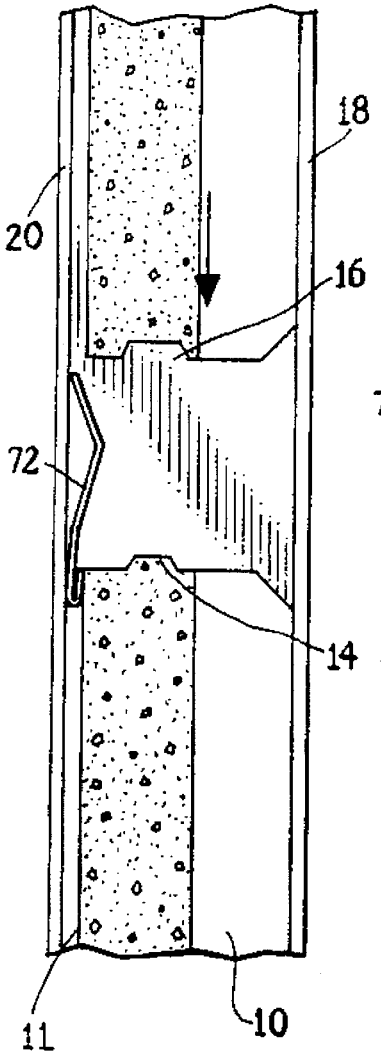
FIG 13
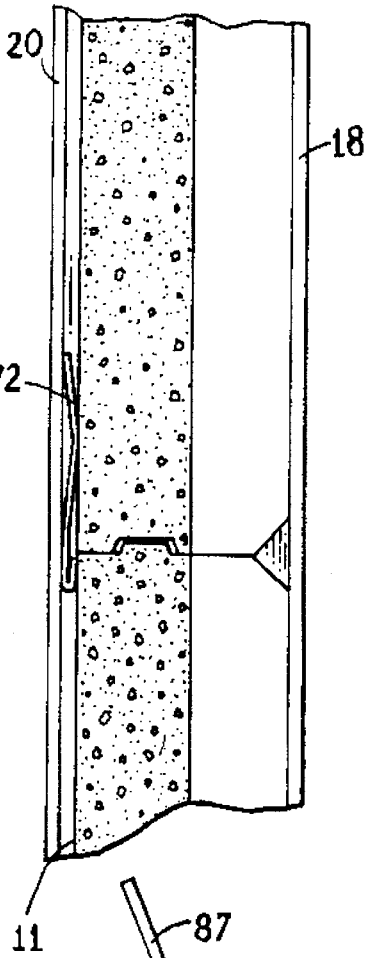
FIG. 14
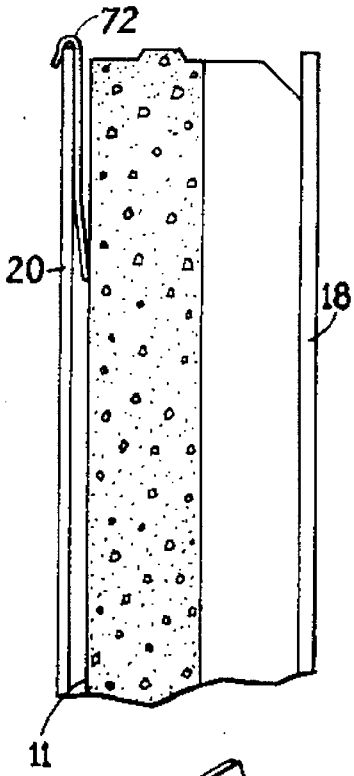
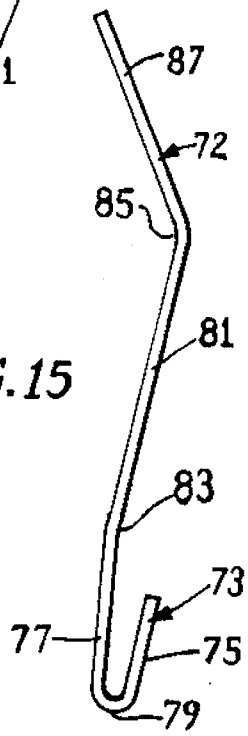
FIG. 15
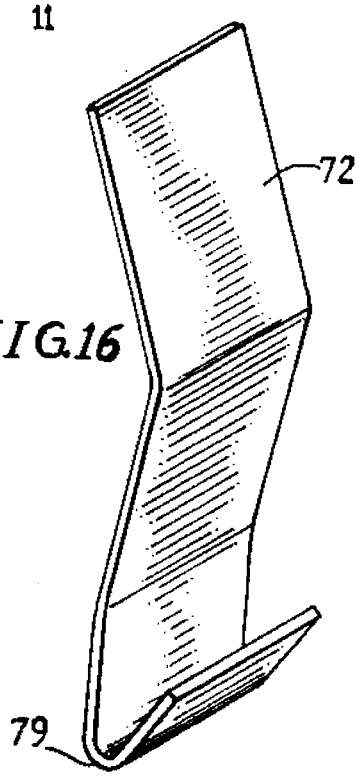
FIG. 16

SPRING BIASED APPARATUS FOR MAINTAINING PRECAST PANELS IN A STABLE REMOVABLE POSITION IN A VERTICAL SLOT

This application is a continuation-in-part of application Ser. No. 08/311,209 filed Sep. 23, 1994, now abandoned which is a continuation of application Ser. No. 07/997,871 filed Dec. 29, 1992 now abandoned.

BACKGROUND OF THE INVENTION

This invention relates to an improved apparatus for holding a road barrier panel tightly and erect in slots provided in opposed support posts.

Multi-lane roadways and rail lines are often a source of constant and undesirable noise due to traffic. To counteract the dispersion of noise from such roadways, various barrier constructions have been developed. For example, timber or wood barriers, metal barriers, concrete barriers and composite material barriers of one type or the other have been proposed and erected in an effort to counteract noise or to dampen the noise emanating from roadways.

A type of such barrier is comprised of spaced, steel H-beam support posts which are erected vertically in a concrete footing. The H-beam posts are spaced from one another by a modular distance. Slots defined by opposed flanges in the H-beam posts are aligned to receive the ends of elongated panels. The panels may be fabricated from precast concrete or a combination of precast concrete with sound adsorbent materials. The panels are assembled in the vertical H-beam posts by sliding each panel downward into the vertical slots defined by the flanges of the posts. Stacking of panels supported by the posts one on top of the other creates a barrier of a desired height. The panels, for example, may have dimensions of 3 feet in width by 12 feet in length by 7 inches in thickness and may be stacked in the manner described in layers of one to as many as eight panels high.

The particular construction described has been found to be highly useful, economical to manufacture and easy to assemble. Further, such a barrier construction has been found to be highly effective in reducing sound dispersion.

During the erection process, various devices have been proposed for maintaining the panels in place in the slots defined by the opposed H-beam posts. For example, anchor brackets have been used. In addition, wedges made from blocks of wood have been utilized.

While these methods for positioning the panels have been useful, they often require assembly techniques which are very time consuming and which may preclude easy disassembly of the walls. Thus, there has resulted a need 16 provide an improved device for erecting, aligning and maintaining panels of the type described when constructing a multi-panel barrier. The present invention contemplates such a development.

SUMMARY OF THE INVENTION

In a principal aspect, the present invention comprises an apparatus as well as a method for wedging the side edge of a road barrier panel into a slot in a panel support post wherein the slot is defined by generally vertical spaced flanges of the post. More specifically, the invention comprises spring biased arms retained near each side of the panel in the face of the panel. The arms bias outwardly from the panel and engage one side or flange defining the slot to thereby tightly wedge the opposite face of the panel against the other flange.

Thus, it is an object of the invention to provide an improved post and panel construction for sound barriers and other types of roadway barriers.

It is a further object of the invention to provide an improved method and apparatus for tightly wedging the panels of a traffic barrier in position in the slot of a vertical post associated with the barrier.

One further object of the invention is to provide a spring biased arm which in combination with the panel will more tightly retain the panel in a vertical slot associated with a support post of a sound barrier.

It is yet another object of the invention to provide a biasing mechanism for supporting a panel which is easy to assemble and which may be assembled generally more rapidly than prior art constructions.

Yet another object of the invention is to provide a traffic and sound barrier assembly which may be assembled more safely.

Another object of the invention is to provide a panel and post construction for a sound barrier for roadways which is economical, has few parts and which may be disassembled with relative ease in the event disassembly is necessary.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 12 is an enlarged cross-sectional view of the post and panel construction in FIG. 11 depicting the process for assembly of the construction;

FIG. 13 is a cross-sectional view of a portion of the post and panel construction of FIG. 11 (labelled FIG. 13);

FIG. 14 is a cross sectional view of a portion of the post and panel construction of FIG. 11 (labelled FIG. 14);

FIG. 15 is a side view of the alternative embodiment of the spring bias arm of the invention as incorporated into the post and panel construction of FIG. 11; and FIG. 16 is a side view of the alternative embodiment of the spring bias arm depicted in FIG. 15.

DESCRIPTION OF THE PREFERRED EMBODIMENT

Prior Art Constructions

Figure 1:
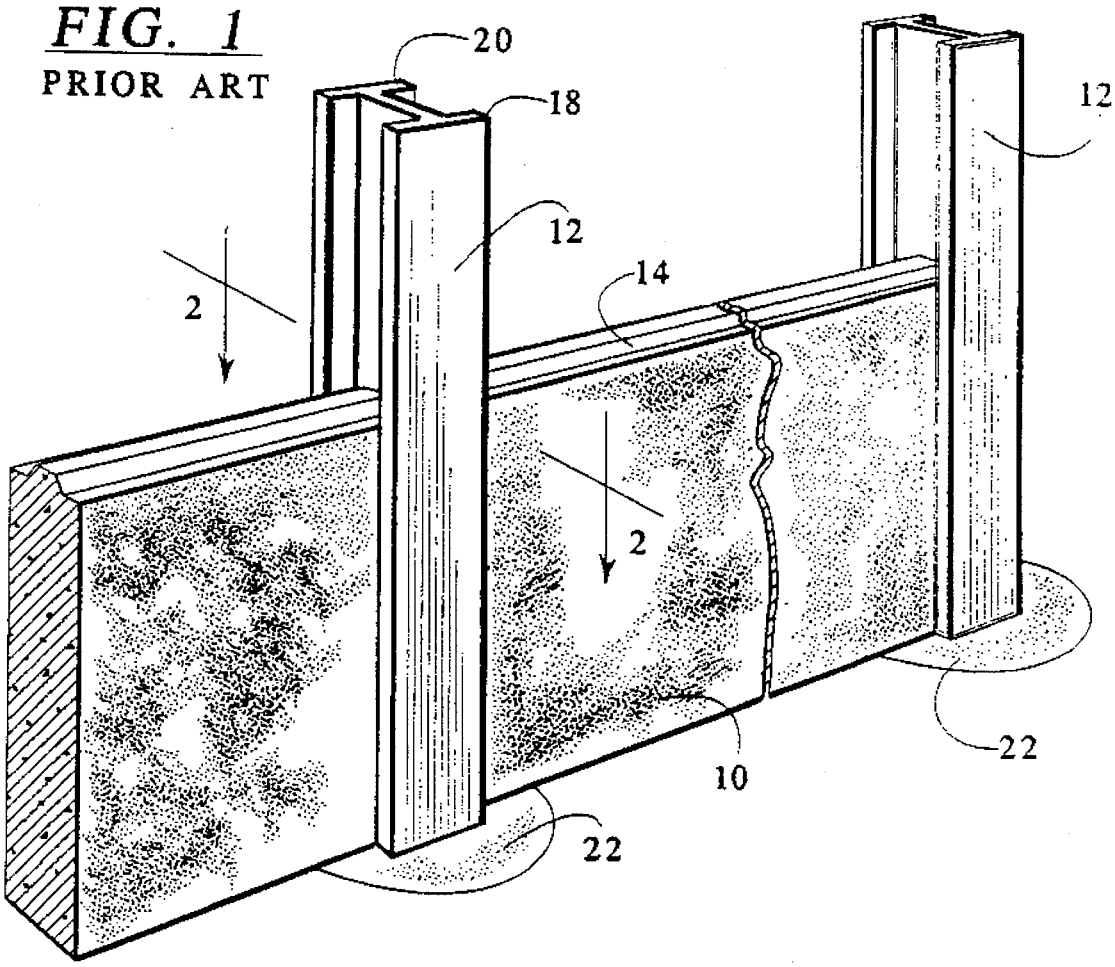
FIG. 1 PRIOR ART
FIG. 1 is a perspective view of a typical post and panel construction which may incorporate the improved apparatus for wedging of the present invention.
Figure 5:
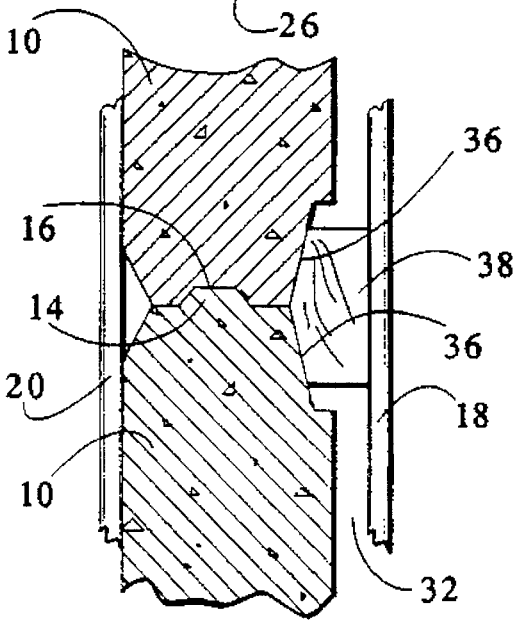
FIG. 5 PRIOR ART
FIG. 5 is an elevation view of the alternative prior art construction of FIG. 4 taken along the line 5—5.

A typical prior art panel construction such as generally depicted in FIG. 1 includes a series of precast panels 10 which are arranged for cooperation with vertical, spaced posts 12. The panels 10 are typically fabricated from a precast concrete material or a composite concrete and sound absorbent material. Thus, a panel 10 may have a height of approximately two to four feet with a length of anywhere from 5 to 20 feet and depth of anywhere from 4 to 8 inches. The particular dimensions of the panels 10 are not a limiting feature of the invention, however. Panels 10 are often precast and transported to an assembly site. The panels 10 also usually include a tongue and groove construction, such as depicted in FIG. 5, or some other interlocking construction. Thus, each panel 10 will include a tongue 14 along one side of a panel which is cooperative with a groove 16 along a side of the next adjacent panel 10. The sides of the panel 10 have generally planar outside surfaces and fit between flanges 18 and 20 of an H-beam post 12 which is set into a footing 22. Spaced footings 22 thus support separate H-beam posts 12. The panels 10 slide into the opposed channels or slots defined by flanges 18 and 20 of the spaced I-beam posts 12.

Figure 2:
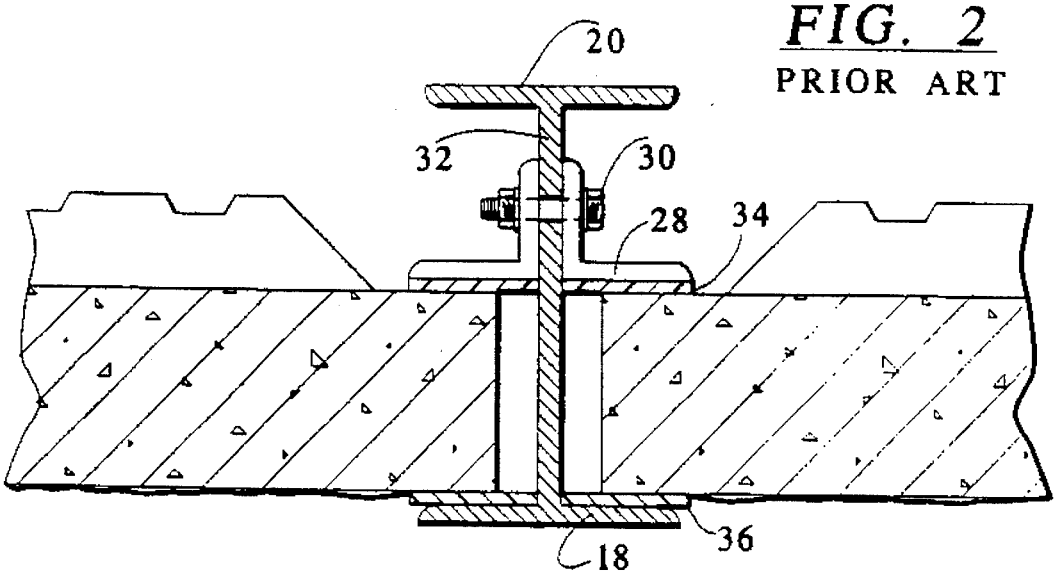
FIG. 2 PRIOR ART
FIG. 2 is a cross-sectional view of a prior art post and panel construction that could be taken along the line 2—2 in FIG. 1.
Figure 3:
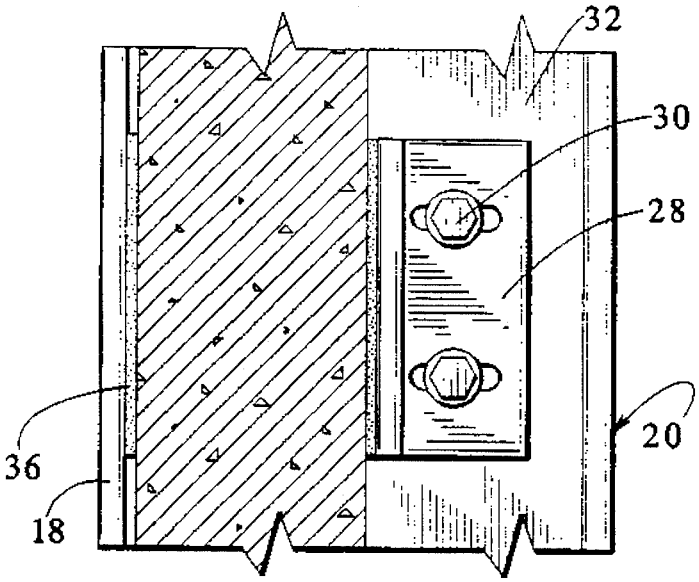
FIG. 3 PRIOR ART
FIG. 3 is a side elevation of the post and panel construction of FIG. 2 taken along the line 3—3.

The flanges 18 and 20 are connected by a web 32 and are spaced one from the other by a distance which is typically greater than the length of the panels 10. Thus a construction must be utilized which will tightly hold or wedge the panels 10 into position between the flanges 18 and 20. FIGS. 2 and 3 illustrate a typical prior art construction for maintaining the panels between the flanges 18 and 20 of an I-beam post 12. That is, panel 10 is held in position against flange 18 by means of a bracket or angle 28 which is bolted by means of bolts 30 to web 32 of H-beam post 12. Elastomeric pads 34 and 36 may be inserted between the bracket 28 and panel 10 and flange 18 and panel 10 to facilitate maintenance of the panel 10 tightly in position. In practice brackets 28 are arranged on both sides of the web 32 to maintain adjacent panels 10 tightly in position with respect to the post 12. FIGS. 2 and 3 illustrate this construction.

Figure 4:
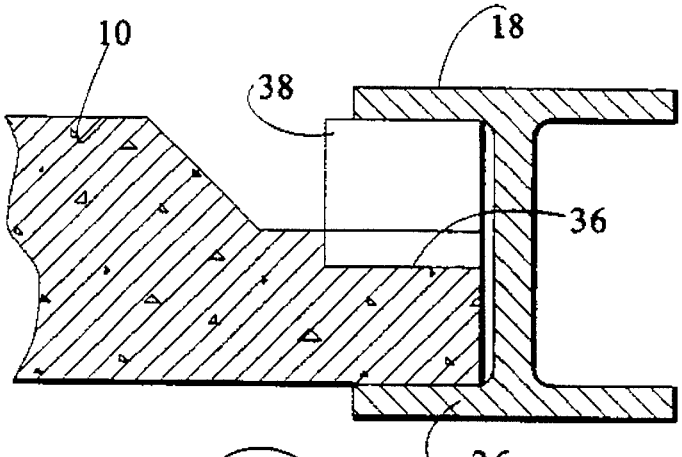
FIG. 4 PRIOR ART
FIG. 4 is a sectional view of an alternative prior art construction similar to FIG. 2.

FIGS. 4 and 5 illustrate yet another prior art construction wherein the panels 10 include a recess 36 at each corner thereof. A wooden block or wedge 38 is shaped to fit into the recesses 36 of vertically adjacent panels 10 to wedge the panels 10 against a forward flange 26. The block 38 thus engages against flange 18 and the recesses 36 to wedge the panels 10.

Embodiments of the Invention

Figure 6:
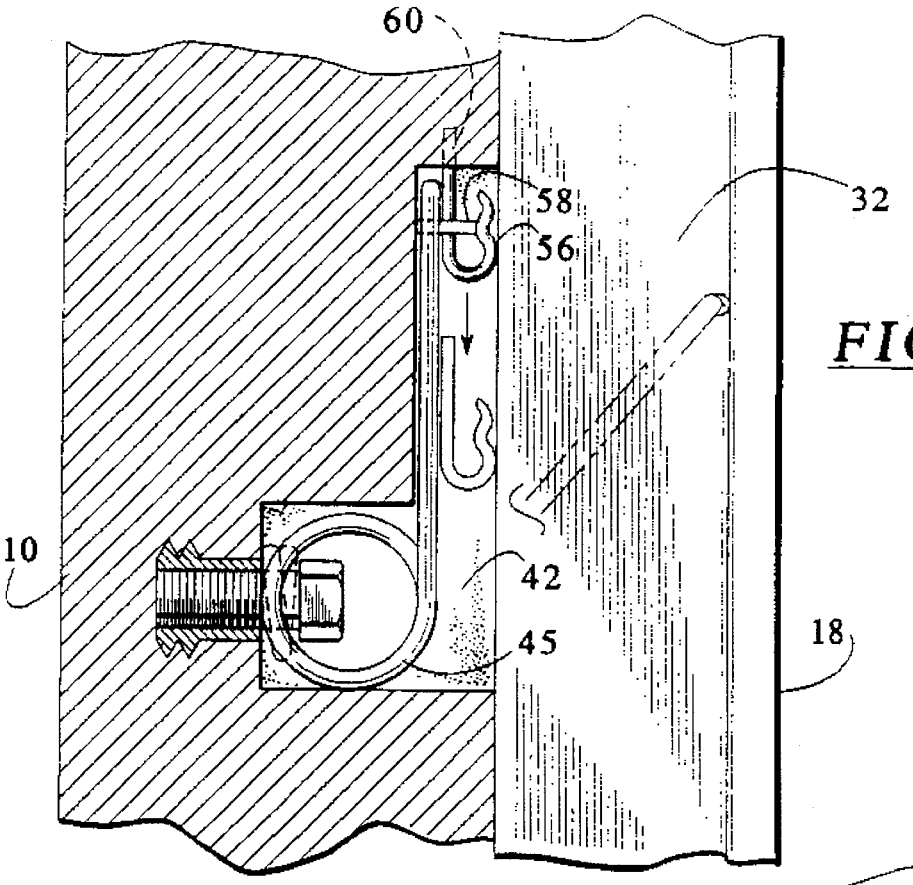
FIG. 6 is a side elevation of the improved post and panel construction incorporating the device of the present invention.
Figure 7:
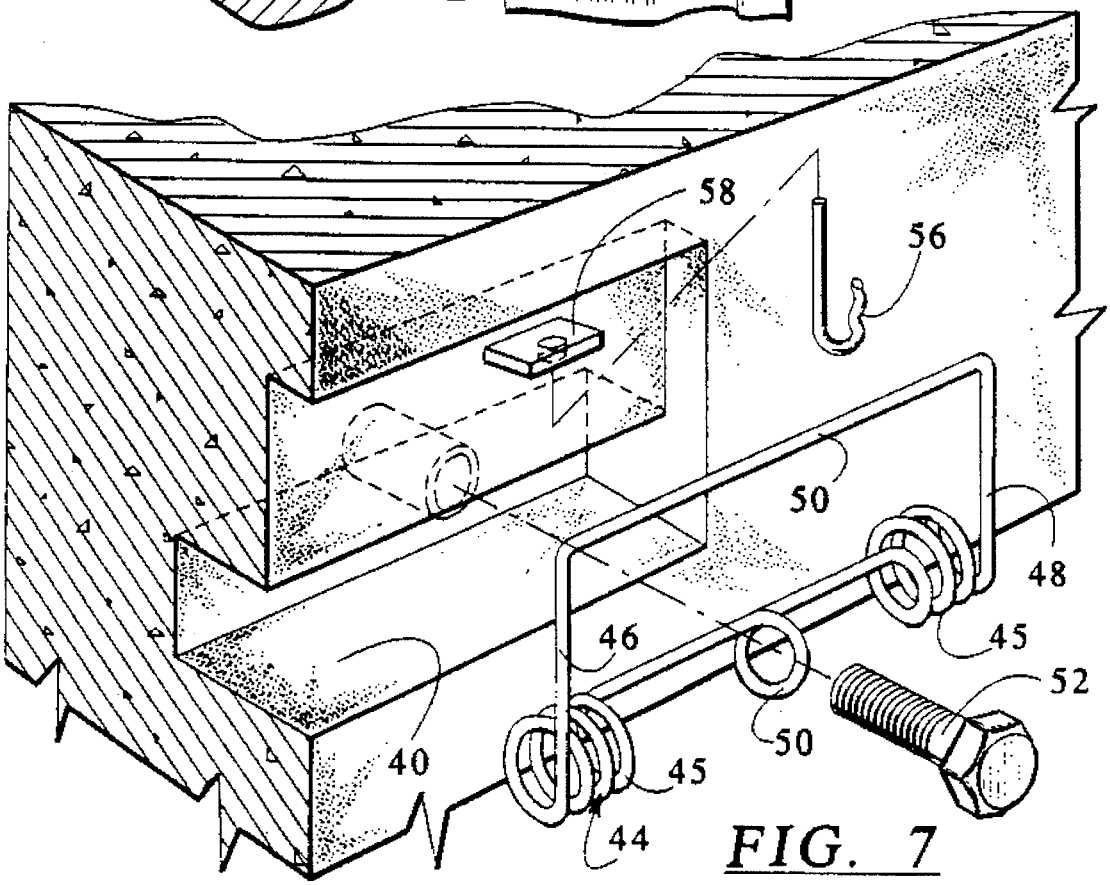
FIG. 7 is a exploded perspective view of the improved device or wedging mechanism of the present invention as incorporated in a panel.
Figure 8:
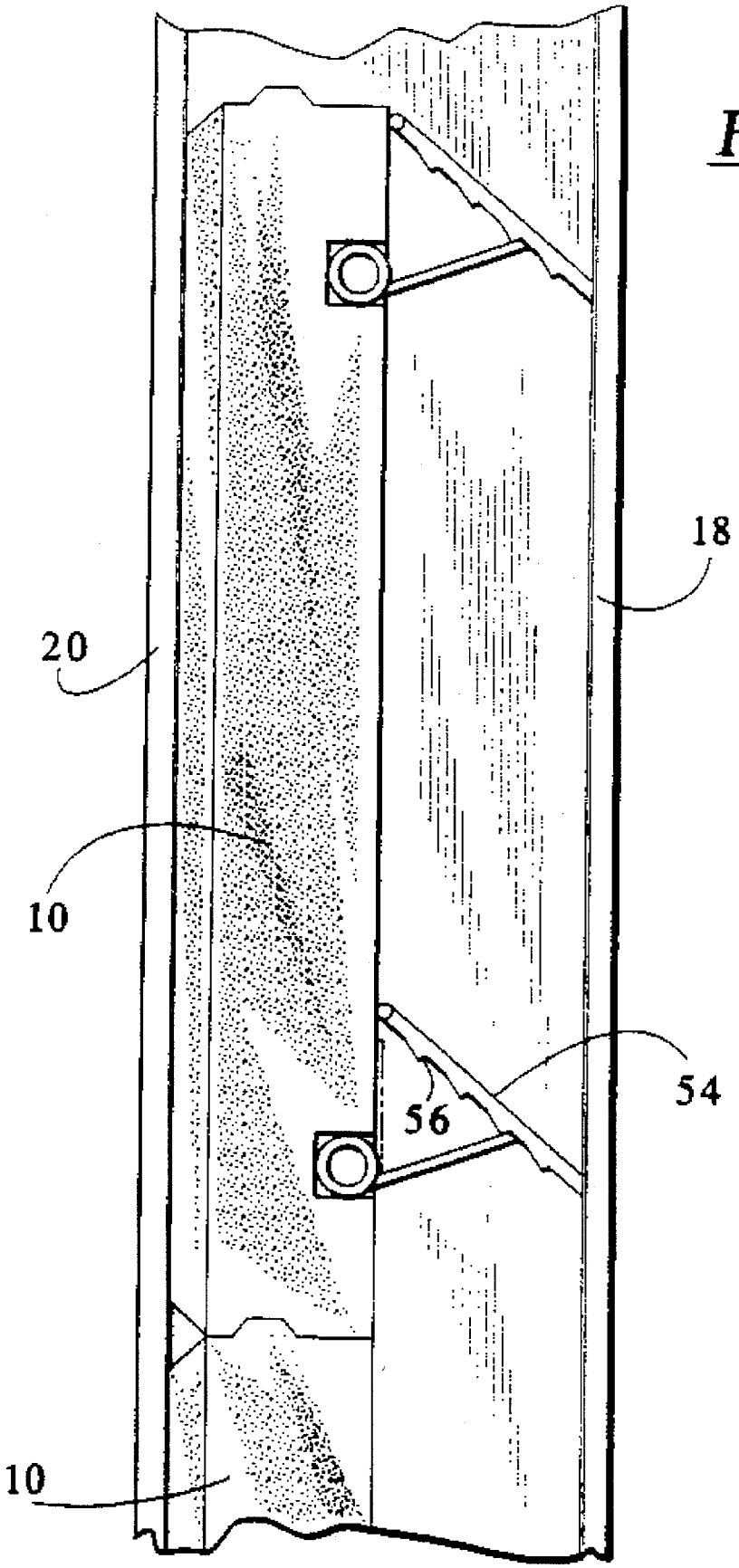
FIG. 8 is an enlarged side elevation similar to FIG. 6 illustrating the improved apparatus of the present invention.

FIGS. 6, 7 and 8 illustrate in greater detail the apparatus of the present invention. In the construction illustrated in these figures, the panel 10 includes a slot 40 which is positioned at each of the corners of the panel 10 adjacent the side 11 of the panel 10. The panel 10 also includes a recess 42 connected with the slot 40. An integral torsion coil spring member 44 includes a first prong or arm 46 extending from one side of the spring coil 45 and a second prong or arm 48 extending from the other side of the spring coil 45. The torsion spring member 44 also includes a center loop 50 for receipt of a fastener 52 such as a bolt. The arms 46 and 48 are optionally connected by a cross member or cross arm 50. The bolt 52 fits through an opening defined by the loop 50 and into a threaded bore or fitting 54 countersunk in the panel 10. Thus the bolt 52 retains as the assembly comprised of the coil 45 and arms 46 and 48 in the slot 40. The coil 45 biases the arms 46 and 48 in the clockwise direction as depicted in FIG. 6.

Prior to insertion of the panel 10 between flanges 18 and 20 of post 12, the arms 46 and 48 as well the cross member 50 are retained within the slot 42 by means of a cotterpin 56 which cooperatively fits through an opening in a plate 58 and into a passage 60 in panel 10 to retain the arms 46 and 48 in the position as depicted in FIG. 6. In the situation where the panel 10 is being combined with a post 12, the pin 56 is first removed to thereby release the arms 46, 48 for movement outward due to the action of the spring 44. The panel 10 is then lowered into the vertical slot defined in opposed posts 12. The panels 10 thus move downwardly between the flanges 18 and 20 defined in the posts 12 by moving in the direction of the arrow in FIG. 6. The torsion spring 44 acting through the arms 46 and 48 which engage flange 20 will cause the panel 10 to be moved toward the flange 18 and retained in position against the flange 18. A plurality of such spring actuated wedging devices may be used in each side of each panel 10. As depicted in FIG. 8 at least two such wedging devices may be utilized to hold a panel 10 in position. More than two may also be utilized depending upon the strength of the spring 44 and other engineering requirements.

FIG. 8 illustrates some further features of the invention. As shown in FIG. 8 an auxiliary keeper bar 54 may be utilized to lock the arms 46 and 48 as well as the cross member 50 into position. The keeper bar is comprised of an elongated bar with projecting tabs 56. The opposite ends of the bar 54 may be coated with highly adherent material to assist in the wedging action. Note that the cross member 50 may be coated with some type of material such as adhesive material or rubberized material to facilitate the locking of the arms and cross member 50 into position.

Figure 9:
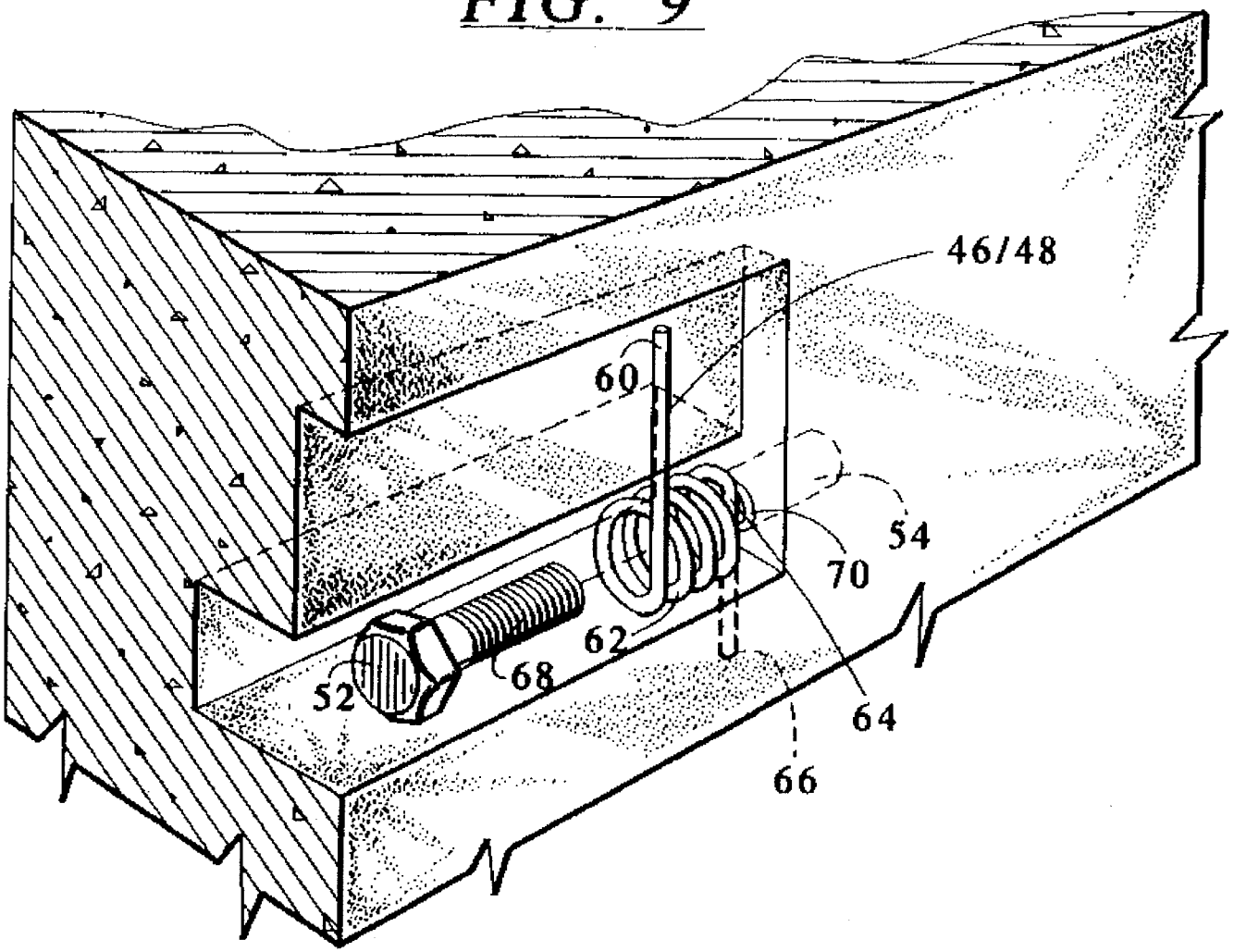
FIG. 9 is a perspective view of an alternative embodiment of the invention.
Figure 10:
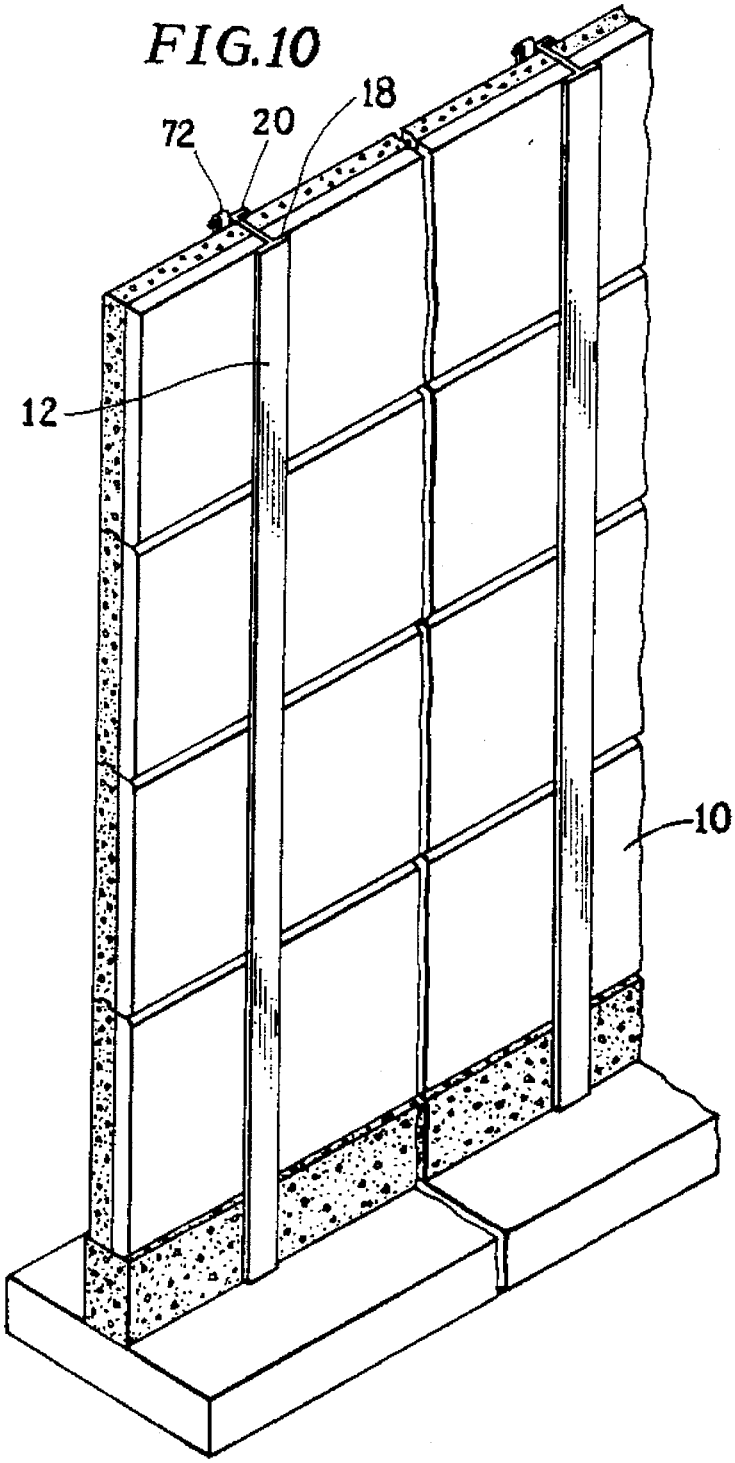
FIG. 10 is a perspective view of a post and panel construction that incorporates an alternative embodiment of the invention.
Figure 11:
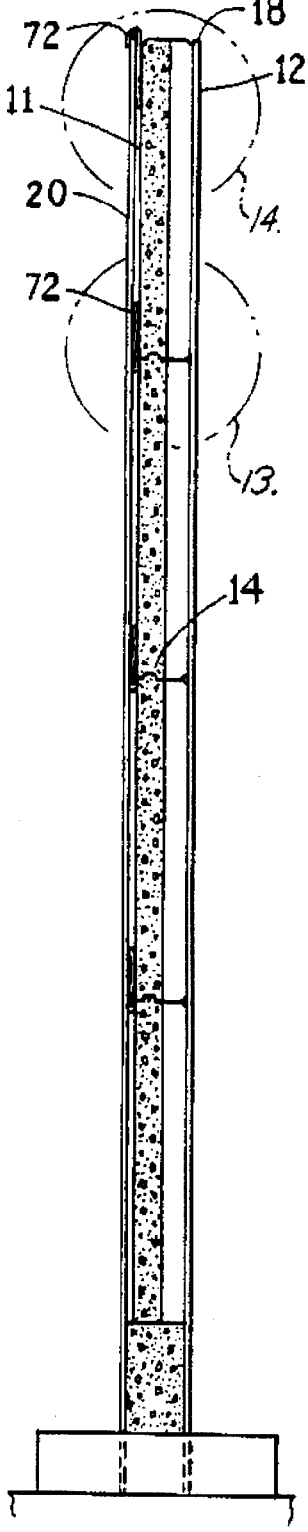
FIG. 11 is a side cross-sectional view of the post and panel construction shown if FIG. 10.

FIG. 9 depicts an alternative embodiment of the invention wherein a single prong 60 is biased by a torsion coil spring 62. The spring 62 includes a lead wire 64 which fits into an opening 66 in the panel 10. A bolt 68 fits through the coil 62 and threads into a fitting 70 recessed in the panel 10. The slot 40 and recess 42 in panel 10 are substantially the same as previously described.

Additionally, there are other alternative features which may be adopted. For example, the cross member 50 may be eliminated from the embodiment of FIG. 7. A series of arms 46 and 48 arranged in generally parallel relation may be utilized rather than one or two arms or prongs. A series of fasteners such as the fastener 52 may be utilized to hold the spring 44 in position within a recess 40 of the slot 42. The shape and configuration of the recess 40 may be altered as desired. The biasing mechanism, namely the spring 44, may be any of a series of choices other than the depicted coil spring 44 or spring clip 72.

FIGS. 10 through 16 depict another alternative embodiment of the invention. Specifically an alternative spring bias mechanism or spring actuated wedging device or spring clip 72 is depicted alone and in combination with a panel and post construction. Thus the panel 10 is arranged for cooperation with vertical, spaced posts 12 in the manner previously described. The panel 10 includes a tongue 14 that slides into a groove 16 along a side of the next adjacent panel 10. The panel 10 slides into the channels or slots defined by the flanges 18 and 20 of a post 12. The panel 10 is held between the flanges 18 and 20 by the spring clip 72. The spring clip 72 is wedged between the outer side 11 of the panel 10 and the flange 20. A plurality of such spring clips 72 may be used to position and maintain multiple panels 10 or multiple clips 72 may be used in combination with a single panel 10.

FIGS. 15 and 16 depict in more in detail the construction of the spring clip 72, which may be made of galvanized steel or coated steel. The spring clip 72 includes a u-shaped resilient clip member or section 73 at one end comprised of spaced runs 75, 77 connected by a crown 79. A high strength, resilient, angled run 81 connects with one run 77 of section 73 to form an obtuse angle 83 as depicted in FIG. 15. The run 81 is, in turn, integrally connected with a run 87 to form an obtuse angle 85 on the opposite side of the clip 72.

In this preferred embodiment the runs 75, 77 are connected by the crown 79 and are also separated a distance sufficient to fill the space between a flange, for example, the flange 20 of an H-beam or post 12, and the surface or outside 11 of a panel 10. The crown 79, which connects the runs 75, 77, constitutes a biasing member that generates elastic forces to maintain those runs 75, 77 in a separated condition and thus will bias or act as a spring between the flange 20 and outside 11 of panel 10. The clip 72 is further configured so as to enhance this biasing effect by virtue of the arrangements of the runs 81 and 87. That is, the length of the runs 81 and 87 as well as the angular relationship between the several runs 81, 87 which form the obtuse angles 83 and 85 as depicted in FIG. 15 may augment the spring action and also provide a further spring capability to the clip 72. For example, the runs 81 and 87, which are connected and form the obtuse angle 85, act as a separate spring member.

It should be noted that the length of the runs 81, 87, 77 and 75 as well as their angular relationship and also as well as the dimensional characteristics of the crown 79 may be adjusted to accommodate various spacings between the flange 20 and panels 10. Also, by varying the length of the various runs and the choice of materials including the spring characteristics and spring constants of such materials, the angular relationship thereof and other physical dimensions and features of the clip 72, it is possible to vary the biasing forces involved and to facilitate the ease with which the spring clip 72 might be utilized. Further, it is possible to vary the number of runs which would be incorporated into the clip 72. In the embodiment shown there are two runs 75, 77 connected by the crown 79 with the supplemental and ancillary additional runs of 81, 87 that form a saw-toothed patterned as viewed in FIG. 15. However, additional runs may be included. It may also be possible to add a u-shape configuration at the opposite end of the clip 72. Various other folds and formations of the clip 72 may also be utilized or adopted to define a spring clip 72.

FIGS. 12, 13 and 14 depict further details about the spring clip 72 in operation. As shown in FIG. 12, the u-shaped end of the spring clip 72 is wedged between the outside edge 11 of panel 10 and the flange 20. The resilient clip 72 provides biasing and pushes the panel 10 toward the flange 18. A second panel 10 is then lowered into the vertical slot defined in opposed posts 12, as shown by the arrow in FIG. 12. The biasing of the angled bends of the spring clip 72 causes the panel 10 to be moved toward the flange 18 and retained in position against the flange 18. The tongue 16 slides into the groove 14.

FIG. 13 depicts the panel 10 after it has been lowered into the assembly. The spring clip 72 is tightly wedged between the panel 10 and the flange 20, and the spring clip 72 pushes the panels 10 toward the flange 18.

As shown in FIG. 14, at the top of the assembly, the u-shaped end of the spring clip 72 may be positioned over the top edge of the flange 20.

While it has been set forth the preferred embodiment of the spring clip 72 it is noted that various alternative constructions and variations of the clip 72 were described. Thus the invention is to be limited by only by the following claims and equivalents.

What is claimed is:

1. An apparatus for wedging a road barrier panel in a slot in a post, said slot defined by spaced flanges of said post, said apparatus including a resilient member and configured for being wedged between said road barrier panel and one of said flanges in said slot, said apparatus comprising a unitary elongate member having a biased run attached thereto at a first end, said biased run spaced from the elongate member.

2. The apparatus of claim 1 wherein said apparatus includes at said first end a u-shaped configuration of the elongate member, said u-shaped configuration including a biasing crown.

3. The apparatus of claim 2 wherein said apparatus is galvanized steel.

4. The apparatus of claim 2 wherein said apparatus is coated steel.

5. The apparatus of claim 1 further including at least one additional run extending from the elongate member and forming an obtuse angle therewith.

6. The apparatus of claim 1 further including at least two connected additional runs extending from the elongate member forming opposite obtuse angles.

7. A method of erection of a post and panel wall of the type including at least two spaced posts with opposed slots defined by parallel flanges and at least one panel, said panel slidably inserted in said slots and thereby held vertically erect to define a wall, said method comprising the steps of slidably inserting said panel in said slots and wedging said panel in said slot with a resilient apparatus, said apparatus comprising a unitary elongate member having a biased run attached thereto at a first end, said biased run spaced from the elongate member.

8. The method as in claim 7 further including the step of engaging said first end of said apparatus with the top of said post, said first end of said biasing apparatus comprising a u-shaped configuration of the elongate member, said u-shaped configuration including a biasing crown.

9. An apparatus for wedging a road barrier panel in a slot in a post, said slot defined by spaced flanges of said post, said apparatus configured for being wedged between said road barrier panel and one of said flanges in said slot, said apparatus including:

a unitary elongate member having a biased run attached thereto at a first end, said biased run spaced from the elongate member;

a u-shaped configuration at said first end of the elongate member, said u-shaped configuration including a biasing crown; and at least one connected additional run extending from the elongate member forming an opposite obtuse angle therewith.

* * * * *